US007010917B2

(12) United States Patent
Billington

(10) Patent No.: US 7,010,917 B2
(45) Date of Patent: Mar. 14, 2006

(54) COMPRESSOR WHEEL ASSEMBLY

(75) Inventor: Anthony Billington, Thurstonland (GB)

(73) Assignee: Holset Engineering Company, Limited, (GB)

( * ) Notice: Subject to any disclaimer, the term of this patent is extended or adjusted under 35 U.S.C. 154(b) by 0 days.

(21) Appl. No.: 10/691,194

(22) Filed: Oct. 22, 2003

(65) Prior Publication Data

US 2004/0115071 A1 Jun. 17, 2004

(30) Foreign Application Priority Data

Oct. 24, 2002 (GB) ..... 0224727

(51) Int. Cl.

| | |
|---|---|
| ***B63H 1/20*** | (2006.01) |
| ***F04B 17/00*** | (2006.01) |
| ***F04B 17/05*** | (2006.01) |
| ***F16D 1/00*** | (2006.01) |

(52) U.S. Cl. ..... 60/605.1; 123/559.1; 416/204 A; 416/244 A; 417/407

(58) Field of Classification Search ..... 60/602, 60/605.1; 123/559.1; 416/244 A, 204 A; 417/407

See application file for complete search history.

(56) References Cited

U.S. PATENT DOCUMENTS

| | | | | |
|---|---|---|---|---|
| 4,519,747 | A * | 5/1985 | Yamazaki et al. | 416/244 A |
| 4,705,463 | A | 11/1987 | Joco | |
| 4,722,630 | A * | 2/1988 | Fang | 416/244 A |
| 5,690,632 | A | 11/1997 | Schwartz et al. | |
| 6,364,634 | B1 * | 4/2002 | Svihla et al. | 417/409 |
| 2004/0126231 | A1 | 7/2004 | Billington | |
| 2004/0126251 | A1 | 7/2004 | Billington | |
| 2004/0131469 | A1 | 7/2004 | Billington | |

FOREIGN PATENT DOCUMENTS

| | | |
|---|---|---|
| JP | 58023587 | 2/1983 |
| JP | 2000303028 | 10/2000 |
| JP | 2001164657 | 6/2001 |
| SU | 531930 | 10/1976 |

* cited by examiner

*Primary Examiner*—Sheldon J Richter
(74) *Attorney, Agent, or Firm*—Krieg DeVault LLP

(57) ABSTRACT

A turbocharger comprises a compressor wheel (7) assembled to one end of a turbocharger shaft (8). A nut (17) is threaded on to the end of the shaft (8) to clamp the wheel (7) on the shaft to prevent both axial movement of the wheel (7) along the shaft (8) and rotational slippage. The torque capacity of the coupling between the compressor wheel (7) and nut (17) is increased by treating contacting surfaces of the coupling to increase their co-efficient of friction.

20 Claims, 2 Drawing Sheets

COMPRESSOR WHEEL ASSEMBLY

Figure 1:
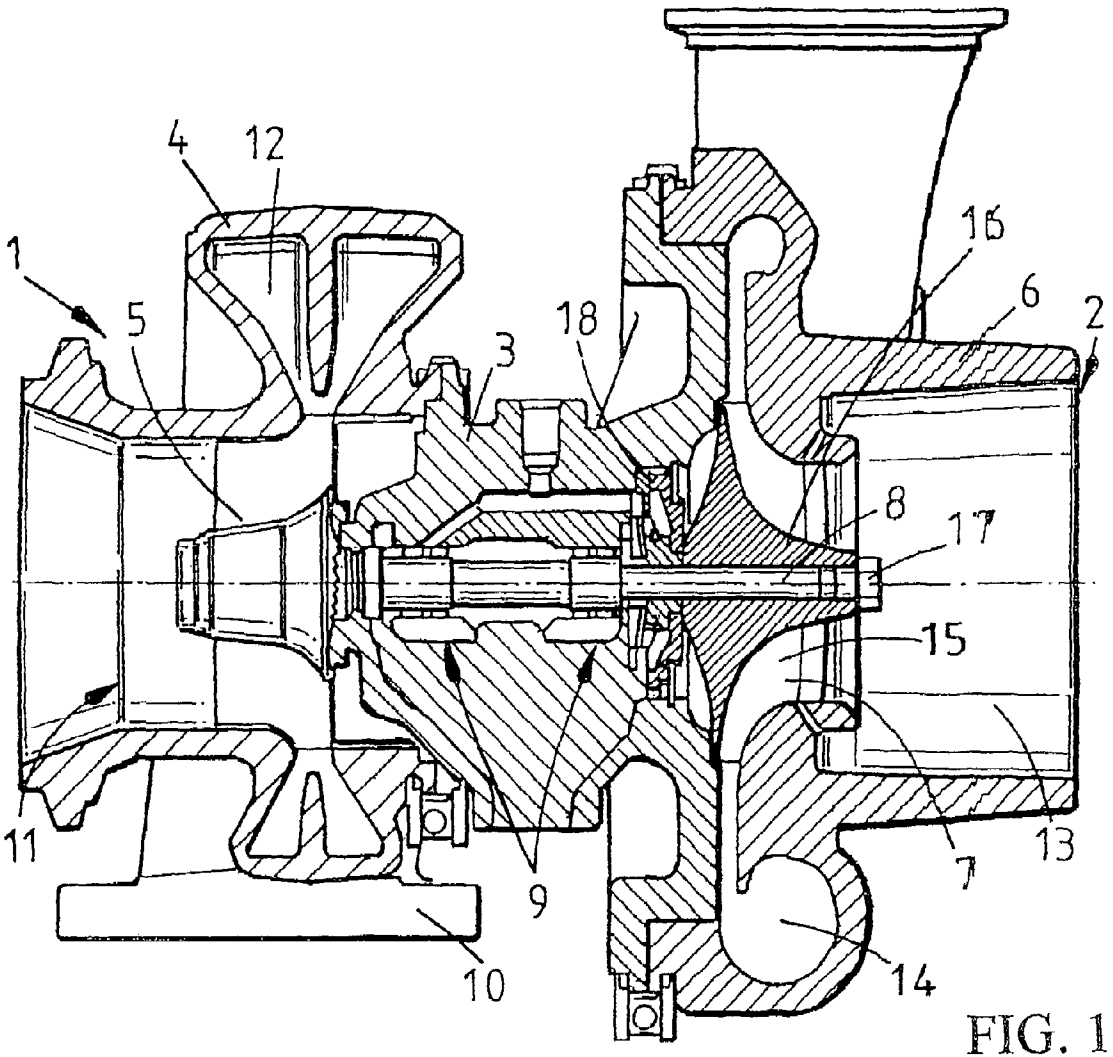

The present application claims priority to British Patent Application No. 0224727.8 filed Oct. 24, 2002, which is incorporated herein by reference.

This invention relates to the assembly of a compressor wheel to a rotating shaft. In particular, the invention relates to the compressor wheel assembly of a turbocharger.

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the intake manifold of the engine, thereby increasing engine power. The shaft is supported on journal and thrust bearings located within a central bearing housing connected between the turbine and compressor wheel housings.

A conventional compressor wheel comprises an array of blades extending from a central hub provided with a bore for receiving one end of the turbocharger shaft. The compressor wheel is secured to the shaft by a nut which threads onto the end of the shaft where it extends through the wheel bore, and bears against the nose end of the wheel to clamp the wheel against a shaft shoulder (or other radially extending abutment that rotates with the shaft). It is important that the clamping force is sufficiently great to prevent slippage of the wheel on the shaft which could throw the wheel out of balance. An unbalanced wheel will at the very least experience increased vibration, which could shorten the working life of the wheel, and at worst could suffer catastrophic failure.

Modern demands on turbocharger performance require increased airflow from a turbocharger of a given size, leading to increased rotational speeds, for instance in excess of 100,000 rpm. To accommodate such high rotational speeds the turbocharger bearings, and thus the turbocharger shaft diameter, must be minimized. However, the use of a relatively small diameter shaft is probomatical with the conventional compressor wheel mounting assembly because the shaft must be able to withstand the high clamping force required to prevent slippage of the wheel. Thus, the strength of the shaft, i.e. the clamping load it can withstand, may limit the mass of compressor wheel that may be mounted to the shaft.

The above problem is exacerbated as continued turbocharger development requires the use of higher performance materials such as titanium which has a greater density than the aluminium alloys conventionally used. The increased inertia of such materials increases the likelihood of compressor wheel slippage, particularly as the compressor wheel rapidly accelerates during transient operating conditions. The clamping force required from a conventional compressor wheel mounting assembly may well exceed that which the shaft can withstand.

One possible way of avoiding the above problem is to use a so-called 'bore-less' compressor wheel such as disclosed in U.S. Pat. No. 4,705,463. With this compressor wheel assembly only a relatively short threaded bore is provided in the compressor wheel to receive the threaded end of a shortened turbocharger shaft. However, such assemblies can also experience balancing problems as the threaded connection between the compressor wheel and the shaft, and the clearance inherent in such a connection, may make it difficult to maintain the required degree of concentricity.

It is an object of the present invention to obviate or mitigate the above problems.

According to a first aspect of the present invention there is provided a turbocharger comprising a turbine wheel mounted to a first end of a shaft for rotation within a turbine housing, and a compressor wheel mounted to a second end of the shaft for rotation within a compressor housing, the compressor wheel having an axial through bore extending between a first end of the wheel and a second end of the wheel, said second end being remote from said turbine, wherein the second end of the shaft extends through the bore and a short distance beyond the second end of the compressor wheel and a nut is threaded onto said second end of the shaft to apply a clamping force to the compressor wheel either directly, or indirectly through an intermediate clamping member disposed around said shaft adjacent the second end of the compressor wheel, such that the second end of the compressor wheel has a radial surface contacting a radial surface of the nut or intermediate clamping member, and wherein at least one of said radial surfaces is treated to increase its co-efficient of friction with respect to the other surface.

The present invention thus increases the torque capacity of the clamping coupling without significant modification of the components of the compressor wheel assembly. The surface treatment may for instance simply increase the roughness of the respective surface, for example by laser etching an appropriate pattern into the surface.

The present invention also provides a method of increasing the torque capacity of an axial clamping assembly of a compressor wheel.

Specific embodiments of the present invention will now be described, by way of example only, with reference to the accompanying drawing which is an axial cross-section through a conventional turbocharger illustrating the major components of a turbocharger and a conventional compressor wheel assembly.

Figure 2:
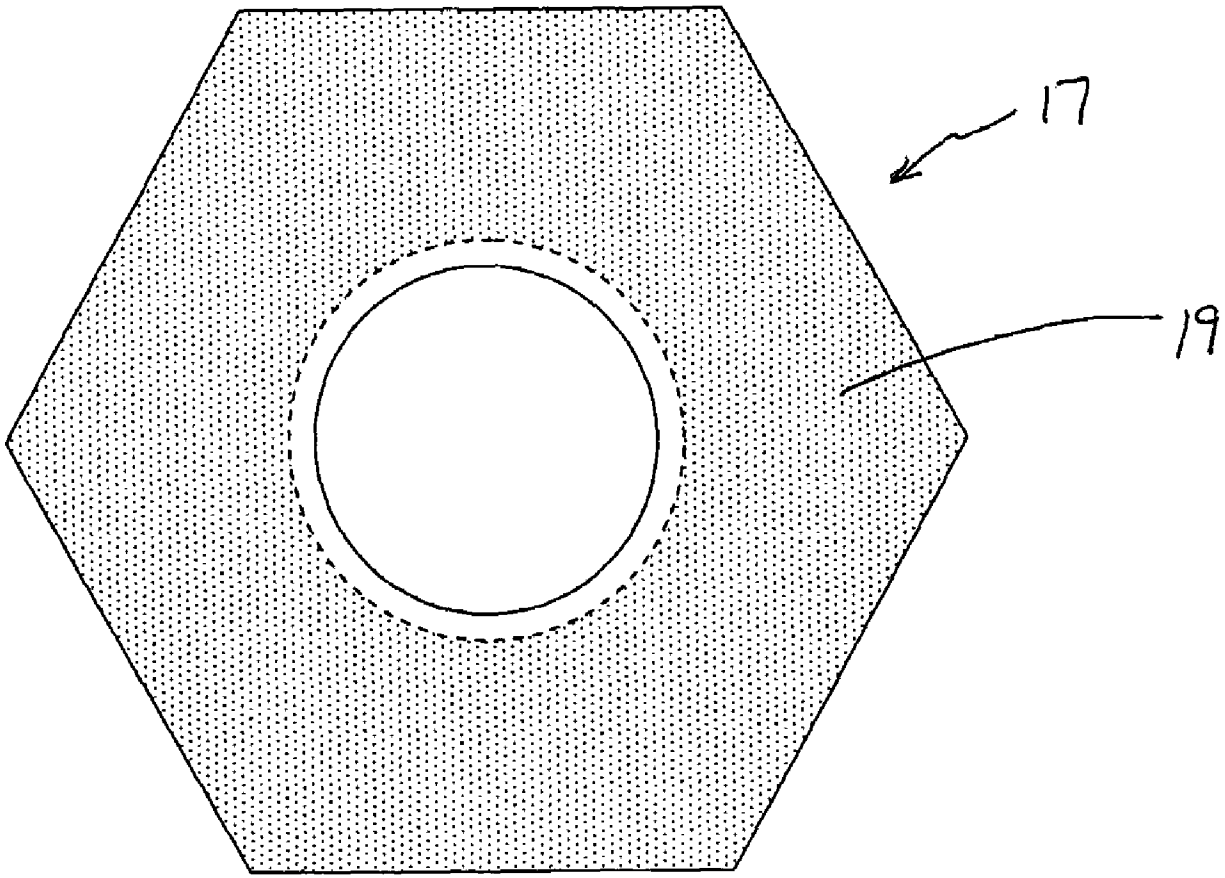

FIG. 1 is an illustrative cross-sectional side view of a non-limiting turbocharger comprising a wheel retained on a turbocharger shaft by a nut; and FIG. 2 is a plan view of a nut with one form of surface treatment to increase the coefficient of friction of the nut face.

The illustrated turbocharger comprises a turbine 1 joined to a compressor 2 via a central bearing housing 3. The turbine 1 comprises a turbine housing 4 which houses a turbine wheel 5. Similarly, the compressor 2 comprises a compressor housing 6 which houses a compressor wheel 7. The turbine wheel 5 and compressor wheel 7 are mounted on opposite ends of a common shaft 8 which is supported on bearing assemblies 9 within the bearing housing 3.

The turbine housing 4 is provided with an exhaust gas inlet 10 and an exhaust gas outlet 11. The inlet 10 directs incoming exhaust gas to an annular inlet chamber 12 surrounding the turbine wheel 5. The exhaust gas flows through the turbine and into the outlet 11 via a circular outlet opening which is co-axial with the turbine wheel 5. Rotation of the turbine wheel 5 rotates the compressor wheel 7 which draws in air through axial inlet 13 and delivers compressed air to the engine intake via an annular outlet volute 14.

Referring in more detail to the compressor wheel assembly, the compressor wheel comprises a plurality of blades 15 extending from a central hub 16 which is provided with a through bore to receive on end of the shaft 8. The shaft 8 extends slightly from the nose of the compressor wheel 7 and is threaded to receive a nut 17 which bears against the compressor wheel nose to clamp the compressor wheel 7 against a thrust bearing and oil seal assembly 18. Details of the thrust bearing/oil seal assembly may vary and are not important to understanding of the compressor wheel mounting arrangement. Essentially, the compressor wheel 7 is prevented from slipping on shaft 8 by the clamping force applied by the nut 17.

Problems associated with the conventional compressor wheel assembly described above are discussed in the introduction to this specification.

In accordance with the present invention the rotational drive force transmitted to the compressor wheel may be increased without increasing the clamping force, or significantly modifying the clamping components. This is achieved by treating the clamping surface of components to increase the co-efficient of friction therebetween.

Referring to the conventional clamping assembly of FIG. 1, the radial surface of the nose portion of the compressor wheel 7, against which the nut 17 bears, may be treated to increase its co-efficient of friction with respect to the nut, for instance by increasing the surface roughness. For example, a laser may be used to etch an appropriate pattern into the surface to increase the surface roughness. This has been found to increase the torque capacity of the clamping joint without compromising the component form tolerances.

The contact surface of the nut 17 may similarly be treated, in addition to or instead of, the treatment of the compressor wheel surface, again to increase the co-efficient of friction between the contacting surfaces. As seen in FIG. 2, the nut 17 has a treated surface 19 which results in an increased coefficient of friction between the treated surface 19 and the nose of the compressor wheel. While FIG. 2 shows the treated surface 19 on the face of the nut 17, it should be understood that a similar treatment may be applied to the nose portion of the compressor wheel, and/or a washer intermediate the nut 17 and the nose of the compressor wheel.

In some clamping arrangements a washer or the like may be disposed between the nut and the compressor wheel, in which case the washer surface contacting the compressor wheel may be treated to provide the increased co-efficient of friction.

It may also be desirable to increase the co-efficient of friction between the back surface of the compressor wheel and the thrust bearing assembly, or other radial surface against which the compressor wheel is clamped by the force supplied by the nut 16. With the illustrated embodiment described above, this would involve treating either the back surface of the compressor wheel or the radial surface of the thrust bearing assembly. On other embodiments, the shaft may be provided with an annular shoulder which bears against the back surface of the compressor wheel and which may similarly be treated.

It will be appreciated that surface treatments other than laser etching may be employed to implement the present invention, including mechanical and chemical treatments appropriate to increase the surface roughness of the respective materials. Appropriate surface treatment methods will be readily apparent to the skilled person.

The invention claimed is:

1. In a turbocharger comprising a turbine wheel mounted to one end of a shaft for rotation within a turbine housing, and a compressor wheel mounted to the other end of the shaft for rotation within a compressor housing, the compressor wheel having an axial through bore extending between a first end of the wheel and a second end of the wheel, said second end being remote from said turbine, wherein the second end of the shaft extends through the bore and a short distance beyond the second end of the compressor wheel and a nut is threaded onto said second end of the shaft to apply a clamping force to the compressor wheel either directly or indirectly through an intermediate clamping member disposed around said shaft adjacent the second end of the compressor wheel, such that the second end of the compressor wheel has a radial surface contacting a radial surface of the nut or intermediate clamping member; a method comprising:

treating at least one of said radial surfaces to increase its co-efficient of friction with respect to the other.

2. A method according to claim 1, wherein said treatment increases the surface roughness of the respective radial surface.

3. A method according to claim 1, wherein said surface treatment comprises laser etching a pattern into the respective surface.

4. A method according to claim 1, wherein said surface treatment comprises mechanical abrasion of the or each surface.

5. A method according to claim 1, wherein said surface treatment comprises chemical etching or abrasion of the or each surface.

6. A method according to claim 1, wherein said surface treatment is applied to both of said radial contact surfaces prior to the nut being threaded onto the second end of the shaft to apply a clamping force to the compressor wheel.

7. A method according to claim 1, wherein the first end of the compressor wheel has a radial surface contacting a radial surface defined by the shaft or a thrust bearing assembly mounted on the shaft, and at least one of said surfaces is treated to increase its co-efficient of friction with respect to the other.

8. A turbocharger comprising a turbine wheel mounted to a first end of a shaft for rotation within a turbine housing, and a compressor wheel mounted to a second end of the shaft for rotation within a compressor housing, the compressor wheel having an axial through bore extending between a first end of the wheel and a second end of the wheel, said second end being remote from said turbine, wherein the second end of the shaft extends through the bore and a short distance beyond the second end of the compressor wheel and a nut is threaded onto said second end of the shaft to apply a clamping force to the compressor wheel either directly, or indirectly through an intermediate clamping member disposed around said shaft adjacent the second end of the compressor wheel, such that the second end of the compressor wheel has a radial surface contacting a radial surface of the nut or intermediate clamping member, and wherein at least one of said radial surfaces is treated prior to contacting the other radial surface to increase its co-efficient of friction with respect to the other surface.

9. A turbocharger according to claim 8, wherein said first end of the compressor wheel is a radial surface which abuts a radial surface defined by the shaft or a thrust bearing assembly mounted on the shaft, and wherein at least one of said surfaces is treated to increase its co-efficient of friction with respect to the other surface.

10. A Turbocharger according to claim 8, wherein said radial surfaces are substantially planer.

11. A Turbocharger according to claim 8, wherein said radial surfaces contact one another and neither radial surface is substantially deformed by contact with the other surface.

12. A turbocharger according to claim 8, wherein both of said surfaces are treated.

13. A Turbocharger according to claim 12, wherein both of said surfaces are treated prior to the radial surfaces contacting one another.

14. A turbocharger according to claim 12, wherein said first end of the compressor wheel is a radial surface which abuts a radial surface defined by the shaft or a thrust bearing assembly mounted on the shaft, and wherein at least one of said surfaces is treated to increase its co-efficient of friction with respect to the other surface.

15. A turbocharger according to claim 8, wherein said surface treatment comprises mechanical abrasion of the or each surface.

16. A turbocharger according to claim 15, wherein said first end of the compressor wheel is a radial surface which abuts a radial surface defined by the shaft or a thrust bearing assembly mounted on the shaft, and wherein at least one of said surfaces is treated to increase its co-efficient of friction with respect to the other surface.

17. A turbocharger according to claim 8, wherein said surface treatment comprises a chemical etching or abrasion process.

18. A turbocharger according to claim 17, wherein said first end of the compressor wheel is a radial surface which abuts a radial surface defined by the shaft or a thrust bearing assembly mounted on the shaft, and wherein at least one of said surfaces is treated to increase its co-efficient of friction with respect to the other surface.

19. A turbocharger comprising a turbine wheel mounted to a first end of a shaft for rotation within a turbine housing, and a compressor wheel mounted to a second end of the shaft for rotation within a compressor housing, the compressor wheel having an axial through bore extending between a first end of the wheel and a second end of the wheel, said second end being remote from said turbine, wherein the second end of the shaft extends through the bore and a short distance beyond the second end of the compressor wheel and a nut is threaded onto said second end of the shaft to apply a clamping force to the compressor wheel either directly, or indirectly through an intermediate clamping member disposed around said shaft adjacent the second end of the compressor wheel, such that the second end of the compressor wheel has a radial surface contacting a radial surface of the nut or intermediate clamping member, and wherein at least one of said radial surfaces includes a laser etched surface to increase its co-efficient of friction with respect to the other surface.

20. A turbocharger according to claim 19, wherein said first end of the compressor wheel is a radial surface which abuts a radial surface defined by the shaft or a thrust bearing assembly mounted on the shaft, and wherein at least one of said surfaces is treated to increase its co-efficient of friction with respect to the other surface.

* * * * *